US011534015B2

(12) United States Patent
Janas

(10) Patent No.: US 11,534,015 B2
(45) Date of Patent: Dec. 27, 2022

(54) SECURABLE DELIVERY STORAGE SYSTEM

(71) Applicant: Drop Box Unlimited LLC, China, MI (US)

(72) Inventor: Michael Janas, China, MI (US)

(73) Assignee: Drop Box Unlimited, China, MI (US)

( * ) Notice: Subject to any disclaimer, the term of this patent is extended or adjusted under 35 U.S.C. 154(b) by 319 days.

(21) Appl. No.: 17/019,739

(22) Filed: Sep. 14, 2020

(65) Prior Publication Data

US 2021/0106160 A1 Apr. 15, 2021

Related U.S. Application Data

(60) Provisional application No. 62/913,777, filed on Oct. 11, 2019.

(51) Int. Cl.
*A47G 29/14* (2006.01)
*A47G 29/30* (2006.01)
*A47G 29/22* (2006.01)

(52) U.S. Cl.
CPC ..... *A47G 29/141* (2013.01); *A47G 29/22* (2013.01); *A47G 29/30* (2013.01); *A47G 2029/147* (2013.01)

(58) Field of Classification Search
CPC ..... A47G 29/22; A47G 29/141; A47G 29/30; A47G 29/28; A47G 2029/142; A47G 2029/145; A47G 2029/147; E05G 7/00; E05G 7/008; E06B 7/32
USPC ..... 232/19, 45, 43.4, 42; 109/67, 68, 19; 49/68
See application file for complete search history.

(56) References Cited

U.S. PATENT DOCUMENTS 4,084,518 A * 4/1978 Carlson ..... E06B 7/32 109/19
4,190,004 A * 2/1980 Richardson ..... E05G 7/008 109/19
4,245,776 A * 1/1981 Miner ..... E06B 7/32 312/286
4,351,247 A * 9/1982 Clark ..... E06B 7/32 109/19
4,517,901 A * 5/1985 Clark ..... E05G 7/008 109/66
4,640,200 A * 2/1987 Richardson ..... E05G 7/008 109/19
4,848,650 A * 7/1989 Roberts, II ..... A47G 29/1209 D99/29

(Continued)

*Primary Examiner* — William L Miller
(74) *Attorney, Agent, or Firm* — RMCK Law Group PLC

(57) ABSTRACT

A securable delivery storage container is configured to extend through a wall of a building and includes a frame assembly configured to be inserted into the wall. The frame assembly includes a first open end disposed at an exterior of the building, and an opposite second open end disposed at an interior of the building. A drawer assembly, which defines a storage area configured to receive deliverables, is slidingly coupled to the frame assembly and slidable between (i) a closed position where the drawer assembly is nested within the frame assembly to prevent access to the storage area from the building exterior, and enable access from the building interior and (ii) an open position where the drawer assembly is extended outwardly from the frame assembly to enable access to the storage area from the building exterior.

18 Claims, 4 Drawing Sheets

(56) References Cited

U.S. PATENT DOCUMENTS 5,205,224 A * 4/1993 Durst ..... E05G 7/008 109/66
5,615,624 A * 4/1997 Terry ..... E05G 7/008 109/66
5,799,589 A * 9/1998 Clark ..... E05G 7/008 109/19
5,802,991 A * 9/1998 Brown ..... E05G 7/008 109/66
5,897,054 A * 4/1999 Firth ..... E06B 7/32 109/19
6,347,737 B1 2/2002 Madruga
7,182,246 B1 2/2007 Sievel
7,320,427 B2 1/2008 Prestwich
7,428,980 B2 9/2008 Irwin et al.
7,641,103 B1 * 1/2010 Tomich ..... E06B 5/02 232/1 E
7,721,660 B1 * 5/2010 Davis ..... E05G 7/008 109/66
8,459,539 B2 6/2013 Bolles
9,955,812 B2 5/2018 Charbeneau
10,398,246 B2 * 9/2019 Crooks ..... A47G 29/12
10,549,926 B2 * 2/2020 Cano Coscia ..... E04F 17/12
10,772,451 B2 * 9/2020 Vernal Silva ..... A47G 29/20
10,954,068 B2 * 3/2021 Nevison ..... G05B 15/02
11,224,302 B2 * 1/2022 Jeffs ..... A47G 29/30
11,278,144 B2 * 3/2022 Vernal Silva ..... A47G 29/20
11,346,150 B1 * 5/2022 Johnston ..... E06B 7/32
11,369,223 B2 * 6/2022 Plummer ..... A47G 29/141
11,399,648 B2 * 8/2022 Lewis ..... A47G 29/22
11,426,020 B2 * 8/2022 Morgan ..... A47G 29/141
11,432,670 B2 * 9/2022 Nakanishi ..... B64F 1/368
2001/0035703 A1 * 11/2001 Scholefield ..... F25D 23/10 312/242
2003/0006275 A1 * 1/2003 Gray ..... A47G 29/14 232/19
2003/0136824 A1 * 7/2003 Simon ..... A47G 29/1209 232/19
2008/0000401 A1 * 1/2008 Weaver ..... E05G 7/008 109/19
2015/0371468 A1 12/2015 Mackin et al.
2017/0213187 A1 * 7/2017 Choi ..... G06K 7/10297
2018/0228310 A1 * 8/2018 Enobakhare ..... A47G 29/20
2019/0217971 A1 * 7/2019 Comerford ..... A47G 29/141
2020/0013008 A1 * 1/2020 Newcomb ..... A47G 29/141
2020/0288895 A1 * 9/2020 Bennet ..... B64C 39/024
2020/0385119 A1 * 12/2020 Hanke ..... A47G 29/12
2021/0005033 A1 * 1/2021 Roman ..... G06Q 10/0833
2021/0045564 A1 * 2/2021 Duckers ..... E05F 15/673
2021/0177182 A1 * 6/2021 Plummer ..... A47G 29/28
2021/0230926 A1 * 7/2021 Schler ..... G06Q 30/0601
2022/0058575 A1 * 2/2022 Moudy ..... H04L 67/125
2022/0079365 A1 * 3/2022 Lewis ..... A47G 29/20
2022/0098927 A1 * 3/2022 Tannoury ..... E05G 7/00

* cited by examiner

SECURABLE DELIVERY STORAGE SYSTEM

CROSS-REFERENCE TO RELATED APPLICATION

This application claims the benefit of U.S. Provisional No. 62/913,777, filed Oct. 11, 2019, the contents of which are incorporated herein by reference thereto.

FIELD

The present application relates generally to delivery package receptacles and, more particularly, to a customizable and securable delivery storage container system.

BACKGROUND

With a simple click of a button, a consumer can quickly order goods from a multitude of internet retailers. In a matter of days or even mere hours, the package is delivered directly to the consumer's home or business. Such convenience has resulted in a dramatic increase in home and business package deliveries. However, if the consumer is unavailable at the time of delivery, the delivery person often simply leaves the package at the delivery address unattended. This potentially exposes the package to loss due to theft or weather exposure. Additionally, some deliveries such as groceries, may be temperature sensitive, which can lead to spoilage if the packages are not retrieved in a timely manner. Accordingly, it is desirable to provide improved package delivery systems in light of the new challenges facing the package delivery industry.

SUMMARY

In accordance with one aspect of the disclosure, a securable delivery storage container configured to extend through a wall of a building is provided. In one example implementation, the securable delivery storage container includes a frame assembly configured to be inserted into the wall and including a first open end disposed at an exterior of the building, and an opposite second open end disposed at an interior of the building. A drawer assembly defines a storage area configured to receive deliverables. The drawer assembly is slidingly coupled to the frame assembly and slidable between (i) a closed position where the drawer assembly is nested within the frame assembly to prevent access to the storage area from the building exterior, and (ii) an open position where the drawer assembly is extended outwardly from the frame assembly to enable access to the storage area from the building exterior. The drawer assembly includes a first side providing a first access point to the storage area on the exterior of the building, and a second side providing a second access point to the storage area on the interior of the building.

In addition to the foregoing, the described securable delivery storage container may include one or more of the following features: an exterior keypad and lock assembly configured to selectively lock the drawer assembly to the frame assembly when the drawer assembly is in the closed position; and wherein the exterior keypad and lock assembly includes a locking pin movable between a locked position where the locking pin extends into the frame assembly, and an unlocked position where the locking pin is withdrawn from the frame assembly, an actuator operably coupled to the locking pin and configured to selectively move the locking pin between the locked position and the unlocked position, and a keypad in signal communication with the actuator, wherein the keypad is configured to generate a signal to command the actuator to move the locking pin between the locked position and the unlocked position.

In addition to the foregoing, the described securable delivery storage container may include one or more of the following features: wherein the keypad is programmable to generate and store at least one unique access code, and wherein when the drawer assembly is in the closed position, the locking pin is in the locked position, and the at least one unique access code is input into the keypad, the keypad generates the signal to command the actuator to move the locking pin between the locked position and the unlocked position; and wherein the keypad is programmable to generate and store a plurality of unique one-time use access codes to supply to delivery persons to open the drawer assembly and place deliverables in the storage area.

In addition to the foregoing, the described securable delivery storage container may include one or more of the following features: a heating/cooling unit coupled to at least one of the frame assembly and the drawer assembly and configured to selectively heat or cool the environment within the storage area based on a type of deliverables; wherein the heating/cooling unit is a thermoelectric device; a sanitization unit coupled to at least one of the frame assembly and the drawer assembly and configured to selectively sanitize the environment within the storage area; and wherein the sanitization unit is a UVC light configured to generate UVC radiation.

In addition to the foregoing, the described securable delivery storage container may include one or more of the following features: wherein the drawer assembly comprises a drawer slidably coupled to the frame assembly by a drawer slide assembly; wherein the drawer includes a front wall assembly, a partial back wall assembly, a bottom wall assembly, and a pair of opposed sidewall assemblies extending between the front wall assembly and the partial back wall assembly; wherein the drawer further comprises a rear access door assembly configured to selectively close the second access point to the storage area on the interior of the building; and wherein the rear access door assembly comprises a rear door rotatably coupled to the partial back wall assembly via a hinge assembly, wherein the rear door is movable between an open position allowing access to the storage area via the second access point, and a closed position preventing access to the storage area via the second access point.

In addition to the foregoing, the described securable delivery storage container may include one or more of the following features: wherein the rear door includes an interior lock assembly configured to selectively lock the rear door in the closed position to facilitate preventing unauthorized access to the storage area from the building interior; a stowable shelf rotatably coupled to the front wall assembly and movable between a horizontal deployed position that provides a shelf surface within the storage area, and a vertical stowed position disposed against the front wall assembly; wherein the frame assembly comprises an upper wall, a lower wall, and a pair of opposed side walls extending between the upper wall and the lower wall, wherein the frame assembly defines a cavity configured to receive the drawer assembly therein; wherein the frame assembly further comprises a pair of lockable rear doors rotatably coupled to the pair of opposed side walls to facilitate preventing unauthorized access to the storage area from the building interior.

In accordance with another aspect of the disclosure, a method of providing security for items delivered to a building is provided. In one example implementation, the method includes providing a frame assembly configured to be inserted into a wall of the building with a first open end disposed at an exterior of the building, and an opposite second open end disposed at an interior of the building. A drawer assembly is provided defining a storage area configured to receive the delivery item, the drawer assembly slidingly coupled to the frame assembly and slidable between (i) a closed position where the drawer assembly is nested within the frame assembly to prevent access to the storage area from the building exterior, and (ii) an open position where the drawer assembly is extended outwardly from the frame assembly to enable access to the storage area from the building exterior. The drawer assembly includes a first side providing a first access point to the storage area on the exterior of the building, and a second side providing a second access point to the storage area on the interior of the building. An exterior keypad and lock assembly is provided, which includes a locking pin movable between a locked position where the locking pin extends into the frame assembly, and an unlocked position where the locking pin is withdrawn from the frame assembly, an actuator operably coupled to the locking pin and configured to selectively move the locking pin between the locked position and the unlocked position, and a keypad in signal communication with the actuator. The method further includes enabling sending of a unique access code to a delivery person delivering the item, and generating a signal, with the keypad, to command the actuator to move the locking pin from the locked position to the unlocked position when the unique access code is input into the keypad to enable the delivery person to access the storage area and deposit the item therein.

In accordance with another aspect of the disclosure, a securable delivery storage container configured to extend through a wall of a building is provided. In one example implementation, the securable delivery storage container includes a frame assembly configured to be inserted into the wall and including a first open end disposed at an exterior of the building, and an opposite second open end disposed at an interior of the building. A drawer assembly defines a storage area configured to receive deliverables. The drawer assembly is slidingly coupled to the frame assembly and slidable between (i) a closed position where the drawer assembly is nested within the frame assembly to prevent access to the storage area from the building exterior, and (ii) an open position where the drawer assembly is extended outwardly from the frame assembly to enable access to the storage area from the building exterior. The drawer assembly includes a first side providing a first access point to the storage area on the exterior of the building, and a second side providing a second access point to the storage area on the interior of the building.

The drawer assembly includes a front wall assembly, a partial back wall assembly, a bottom wall assembly, a pair of opposed sidewall assemblies extending between the front wall assembly and the partial back wall assembly, and a rear access door rotatably coupled to the partial back wall assembly and movable between an open position allowing access to the storage area via the second access point, and a closed position preventing access to the storage area via the second access point. At least one lockable rear door is rotatably coupled to the frame assembly and movable between an open position allowing access to the drawer assembly from the interior of the building, and a closed position to facilitate preventing access to the drawer assembly from the interior of the building.

An exterior keypad and lock assembly is configured to selectively lock the drawer assembly to the frame assembly when the drawer assembly is in the closed position. The keypad and lock assembly includes a locking pin movable between a locked position where the locking pin extends into the frame assembly, and an unlocked position where the locking pin is withdrawn from the frame assembly, an actuator operably coupled to the locking pin and configured to selectively move the locking pin between the locked position and the unlocked position, and a keypad in signal communication with the actuator. The keypad is programmable to generate and store a plurality of unique access codes to provide to delivery persons. When the drawer assembly is in the closed position, the locking pin is in the locked position, and one of the unique access codes is input into the keypad, the keypad generates the signal to command the actuator to move the locking pin from the locked position to the unlocked position.

In addition to the foregoing, the described securable delivery storage container may include one or more of the following features: an actuator assembly coupled between the frame assembly and the drawer assembly, the actuator assembly configured to automatically move the drawer assembly from the closed position to the open position when one of the unique access codes is input into the keypad; a thermoelectric heating/cooling unit coupled to at least one of the frame assembly and the drawer assembly and configured to selectively heat or cool the environment within the storage area based on a type of deliverables; and a sanitization unit coupled to at least one of the frame assembly and the drawer assembly and configured to selectively sanitize the environment within the storage area, wherein the sanitization unit is a UVC light.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings referenced therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DESCRIPTION

According to the principles of the present application, systems and methods are described for securing deliveries to a building such as a home, garage, or office. A securable delivery storage container is integrated into the building wall and includes dual access points: one for a delivery person on the outside of the building, and the other for the consumer on the inside of the building. For increased security, the delivery storage container includes a programmable keypad that provides a delivery person a one-or-more-time access thereto. In this way, the delivery person can quickly and conveniently place the delivered items into the delivery storage container and re-secure the delivery storage container. As such, the delivered items remain safely locked and protected from theft and weather in the delivery storage container until the consumer safely retrieves the items from inside the building. Furthermore, the delivery storage container is insulated and optionally includes a heating/cooling system to maintain delivered items at a desired temperature, as well as a sanitization device to disinfect the delivered items.

Figure 2:
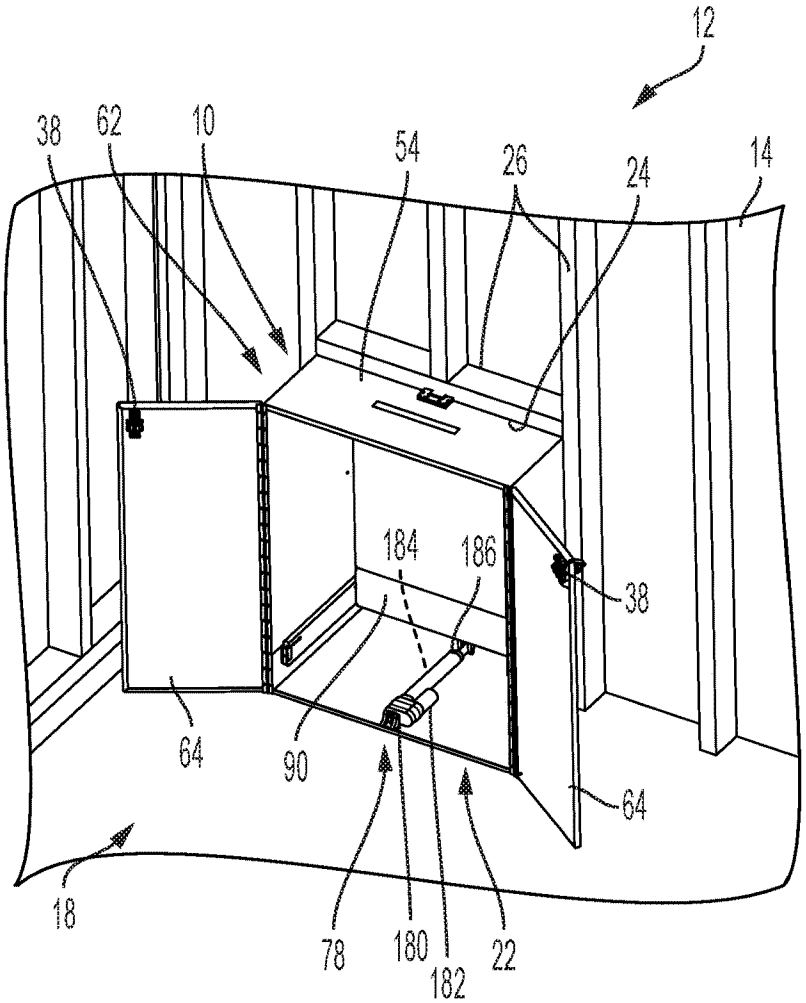
FIG. 2 is an interior view of the building of FIG. 1 showing the securable delivery storage container in the open position.
Figure 1:
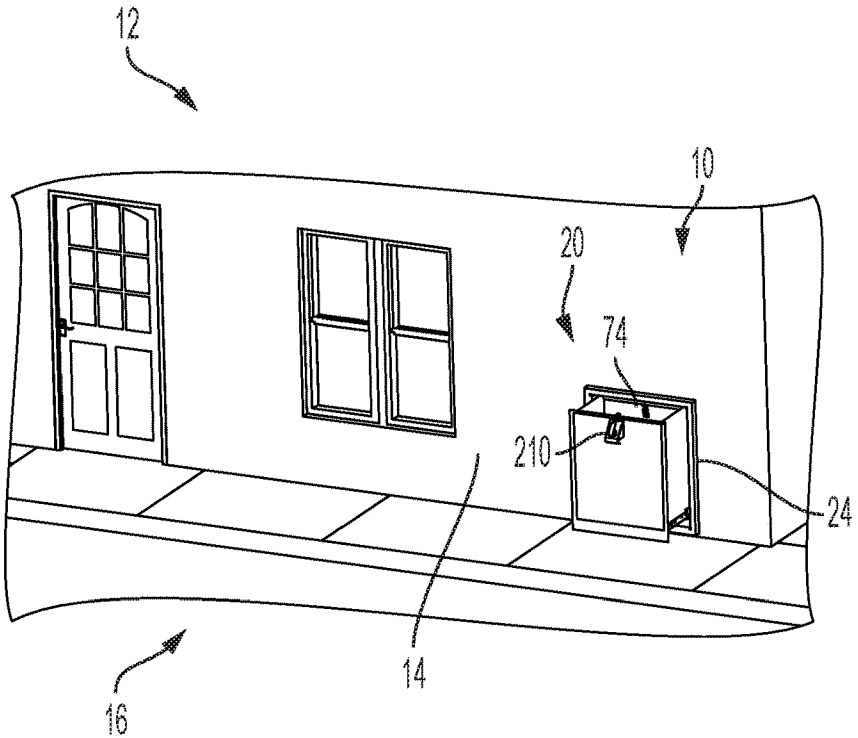
FIG. 1 is an exterior view of a building integrated with an example securable delivery storage container, shown in an open position, in accordance with the principles of the present disclosure.

With initial reference to FIGS. 1 and 2, a dual-access securable storage container for deliverables is shown and generally identified at reference numeral 10. In the example embodiment, the securable delivery storage container 10 is configured to be installed or integrated into a portion of a building 12 such as, for example, a garage wall 14. As shown in FIG. 1, securable delivery storage container 10 includes a first side 20 providing a first access point for a delivery person on an exterior 16 of the building 12. As shown in FIG. 2, the securable delivery storage container 10 further includes a second side 22 providing a second access point for a customer on an interior 18 of the building 12. In this way, the delivery person can place a delivery item into the securable delivery storage container 10 from the first side 20 located on the building exterior 16. The delivery item is then safely secured within the delivery storage container 10 until the customer retrieves the delivery item through the second side 22 on the building interior 18.

With additional reference to FIGS. 3-6, the securable delivery storage container 10 will be described in more detail. In the example embodiment, the securable delivery storage container 10 generally includes a frame assembly 30, a drawer assembly 32, and a sleeve assembly 34. One or more portions of the frame assembly 30, drawer assembly 32, and sleeve assembly 34 may be fabricated from any suitable durable, structural material such as, for example, wood, plastic, fiberglass, metal, metal alloy, or the like. Additionally, in some embodiments, the securable delivery storage container 10 further includes one or more of an exterior keypad and lock assembly 36, an interior lock assembly 38, a heating/cooling unit 40, and a sanitization device 42 (see FIG. 6).

Figure 6:
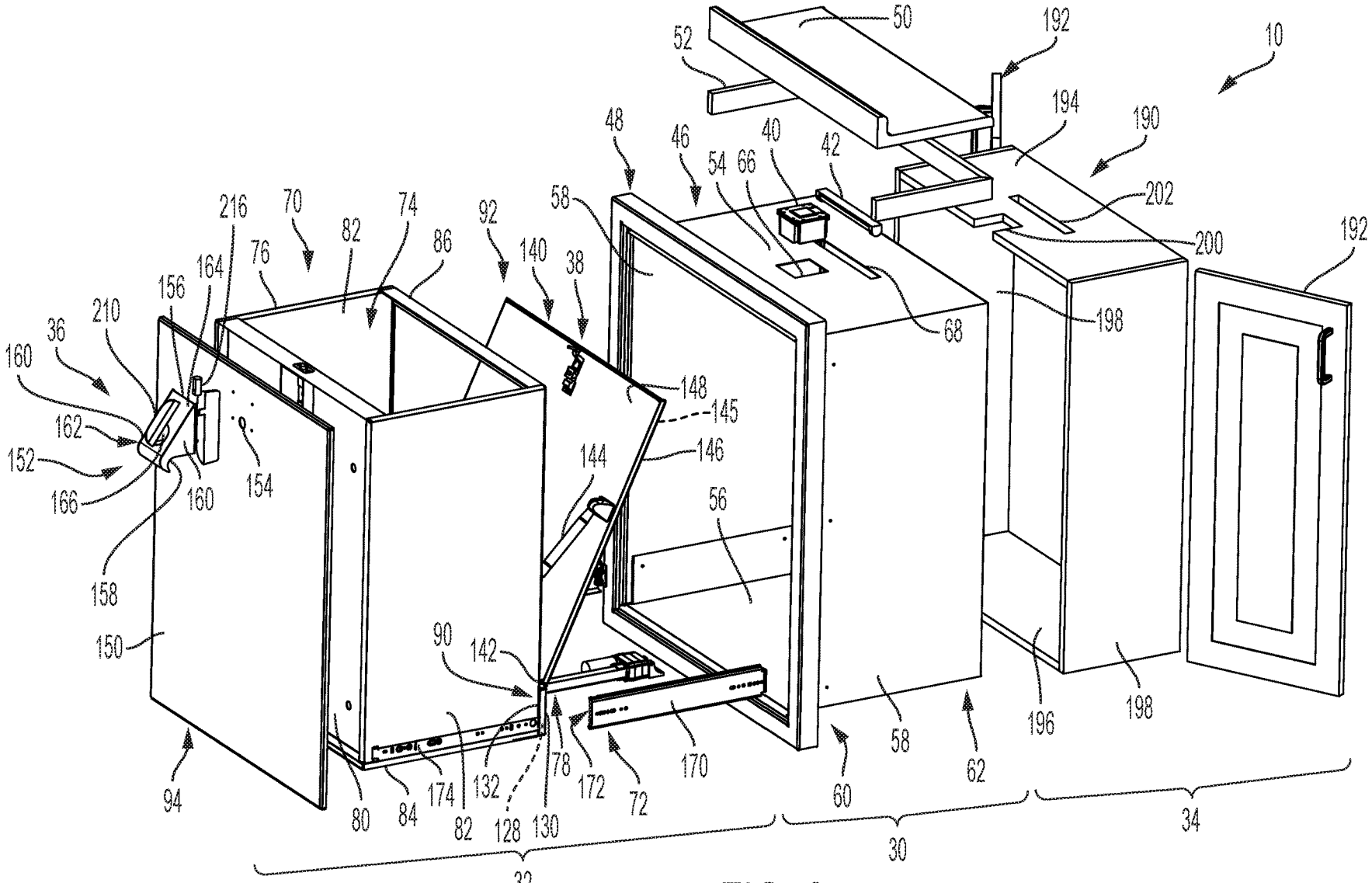
FIG. 6 is an exploded view of the securable delivery storage container shown in FIGS. 1-5 along with an example sleeve assembly.

In the example embodiment, the frame assembly 30 generally includes a cabinet or shell 46, a frame 48, and a shelf or worksurface 50. As shown in FIG. 6, the shell 46 is substantially rectangular and includes a first pair of opposed upper and lower walls 54, 56 coupled to and extending between a second pair of opposed side walls 58. The shell 46 is configured to be inserted into a complementary shaped hole 24 formed through the building wall 14 (see FIGS. 1 and 2). The shell 46 can then be further secured to the building wall 14, for example via coupling to studs 26 (FIG. 2) or any other suitable means. A front end 60 of the shell 46 is configured to be disposed flush with or substantially flush with the outer surface of building wall 14, and frame 48 is configured to be disposed against the outer surface of the building wall 14 to cover and seal any gaps between the shell 46 and the building wall 14.

As shown in FIG. 2, a rear end 62 of the shell 46 includes a pair of rear doors 64 rotatably coupled to the shell side walls 58. One or more of the rear doors 64 (both shown) can include the interior lock assembly 38, which enables the rear doors 64 to be selectively locked in the closed position to facilitate preventing unauthorized access to the drawer assembly 32 and thus any deliverables stored therein. Once unlocked, the rear doors 64 can be swung open to allow access to any deliverables within the drawer assembly 32.

Figure 5:
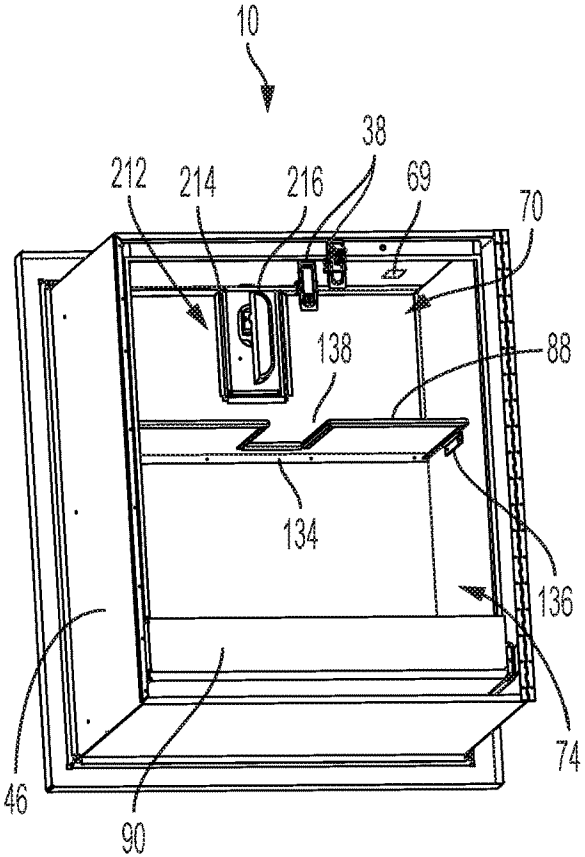
FIG. 5 is a rear perspective view of the securable delivery storage container shown in FIG. 4 with rear doors removed.
Figure 4:
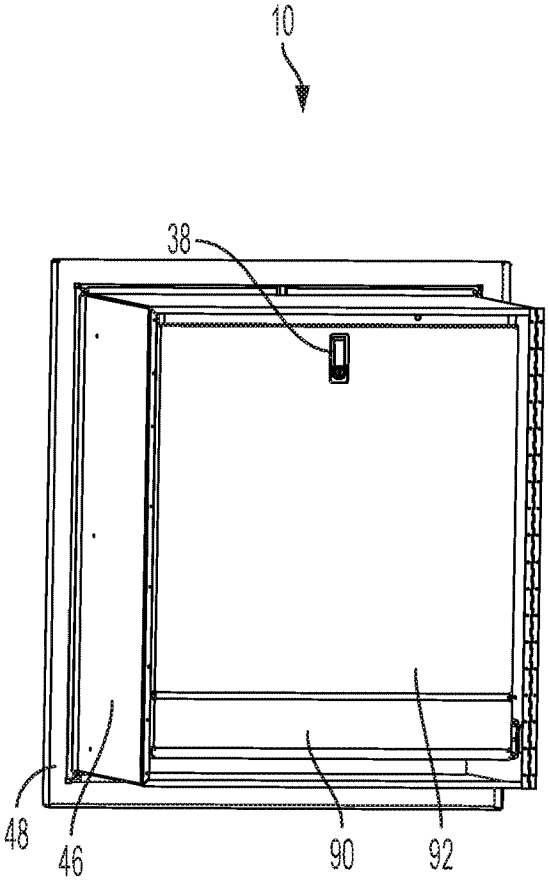
FIG. 4 is a rear perspective view of the securable delivery storage container shown in FIG. 3 with some rear doors removed.

As shown in FIG. 6, in some embodiments, upper wall 54 includes a first aperture 66 and a second aperture 68 formed therethrough. As described herein in more detail, the first aperture 66 is configured to removably receive the heating/cooling unit 40, and the second aperture 68 is configured to removably receive the sanitization device 42. As shown in FIG. 5, an inside of the upper wall 54 includes an interior light 69, which is configured to illuminate at least a portion of the storage area 74 and may be motion activated. However, it will be appreciated that lower wall 56 and/or side walls 58 may alternatively or additionally include interior light 69. Further, as described herein in more detail, a drawer actuator assembly 78 is configured to be coupled to an inner surface of the lower wall 56 (see also FIG. 2).

If the securable delivery storage container 10 does not include the sleeve assembly 34, the upper wall 54 is configured to support the worksurface 50 via a spacer 52, which is configured to separate the worksurface 50 from the upper wall 54 to provide packaging space for the heating/cooling unit 40, and/or the sanitization device 42. The worksurface 50 is configured to provide a working surface for the consumer to place items, such as the delivered items retrieved from the drawer assembly 32. Further, the worksurface 50 is removably coupled to the spacer 52 to enable access to the apertures 66, 68, heating/cooling unit 40, and/or sanitization device 42. If the securable delivery storage container 10 does include the sleeve assembly 34, upper wall 54 is further configured to support one or more portions of the sleeve assembly 34, which then supports the worksurface 50 and spacer 52.

With continued reference to FIGS. 3-6, the drawer assembly 32 will be described in more detail. In the illustrated example, the drawer assembly 32 generally includes a drawer 70 slidingly coupled to the frame assembly 30 via a drawer slide assembly 72 to selectively provide access to a storage area 74 defined by the drawer 70. In this way, the drawer 70 is configured to be moved between a closed position (FIG. 3) and an open position (FIG. 1). In the closed position, the drawer 70 is nested within the frame assembly 30, thereby preventing access to the storage area 74 from the building exterior 16. In this position, the drawer 70 can then be locked via the exterior keypad and lock assembly 36 and the interior lock assembly 38 to facilitate preventing unauthorized accessibility to storage area 74, as described herein in more detail. To move to the open position (FIG. 1), the drawer 70 is slid outward and away from the frame assembly 30 and building wall 14, thereby providing access to the storage area 74 through an upper opening 76 and enabling the delivery person to place the delivery items therein. In some embodiments, the drawer assembly 32 includes an actuator assembly 78 configured to automatically move the drawer 70 between the open and closed positions.

Figure 7:
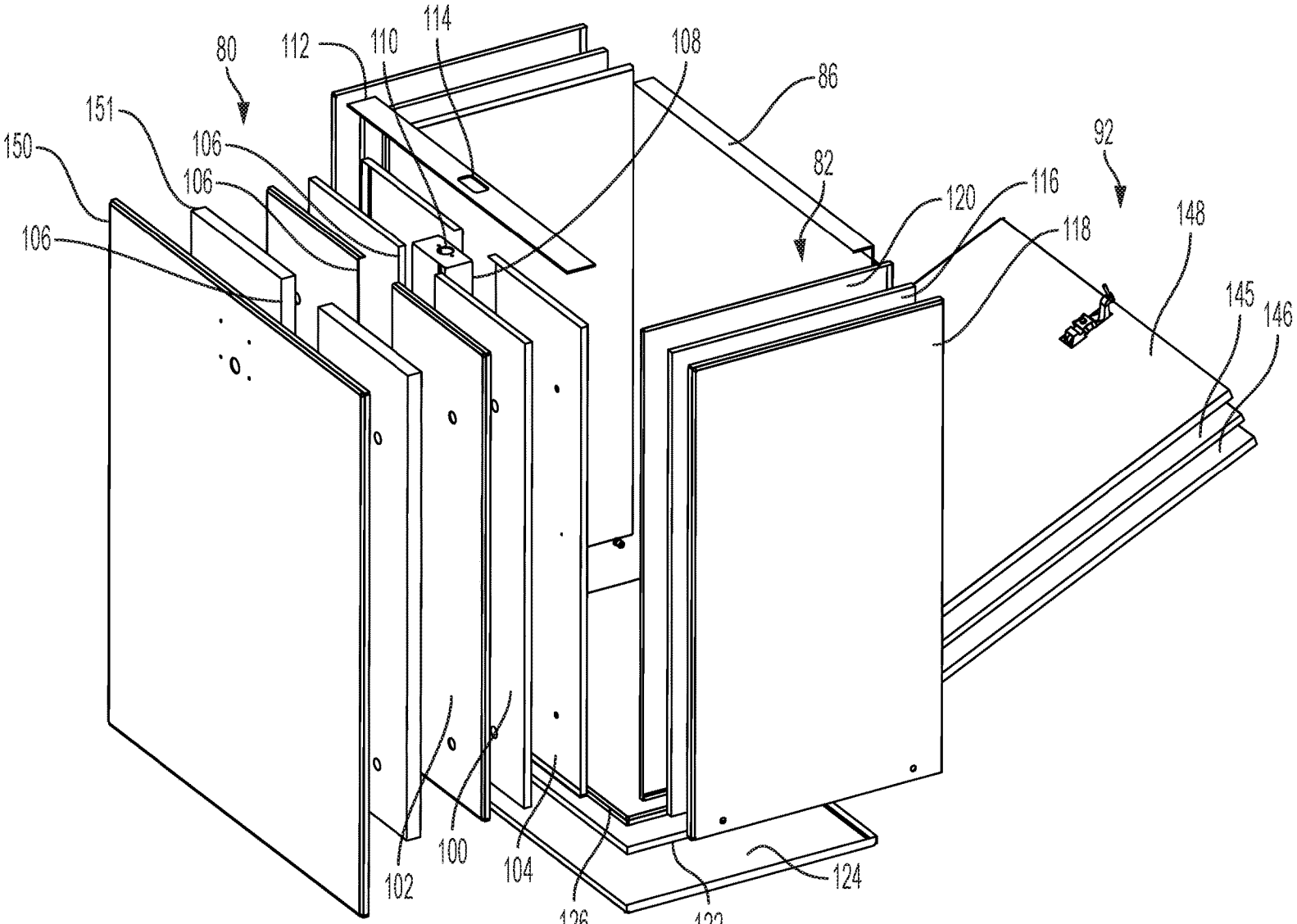
FIG. 7 is an exploded view of a drawer assembly of the securable delivery storage container shown in FIG. 6.

With additional reference to FIG. 7, in the example embodiment, the drawer 70 generally includes storage area 74, which is at least partially defined by a front wall assembly 80, a pair of opposed side wall assemblies 82, a bottom wall assembly 84, a cross-brace 86, a stowable shelf 88 (FIG. 5), a partial back wall assembly 90, a rear access door assembly 92, and/or a front door assembly 94.

As shown in FIG. 7, the front wall assembly 80 includes a front insulation layer 100 disposed between a front outer panel 102 and a front inner panel 104. A cutout 106 is formed in each of the front insulation layer 100 (e.g., foam insulation) and panels 102, 104 and is configured to at least partially receive an inner lock mount 108. In the example embodiment, the inner lock mount 108 defines a receiving area configured to receive at least a portion of the exterior keypad and lock assembly 36, which includes a deadbolt configured to be selectively extended through an aperture 110 formed in the inner lock mount 108. An upper plate 112 is secured to the upper end of at least one of the front wall assembly 80, the sidewall assemblies 82, and the inner lock mount 108 to thereby secure the inner lock mount 108 within the cutout 106. An aperture 114 is formed in the upper plate 112 configured to align with the aperture 110 to allow the deadbolt to selectively extend therethrough and into the frame assembly 30 to secure the drawer 70 in the closed position.

In the example embodiment, each of the side wall assemblies 82 includes an insulation layer 116 disposed between a side outer panel 118 and a side inner panel 120. Similarly, the bottom wall assembly 84 includes an insulation layer 122 disposed between a bottom outer panel 124 and a bottom inner panel 126. The cross-brace 86 is coupled to and extends between an upper rear end of the side wall assemblies 82, while the partial back wall assembly 90 is coupled to and extends between a lower rear end of the side wall assemblies 82. As shown, the partial back wall assembly 90 is formed from an insulation layer 128 disposed between a back outer panel 130 and a back inner panel 132.

As shown in FIG. 5, the stowable shelf 88 is rotatably coupled to the front wall assembly 80 via a hinge assembly 134 to enable the stowable shelf to move between a generally horizontal deployed position (FIG. 5) and a generally vertical stowed position (not shown). In the horizontal deployed position, stowable shelf 88 is supported on either side by a shelf support 136 (only one shown) coupled to each side wall assembly 82. In this position, the stowable shelf 88 provides an additional elevated support surface to receive the deliverables, and also includes one or more large item apertures 138 to enable long/narrow deliverables to pass therethrough while in the deployed position. When desired, for example to receive larger and/or tall delivery items, the stowable shelf 88 is rotated upward into the vertical position against the front wall assembly 80 and releasably secured thereto. Stowable shelf 88 may be releasably secured to front wall assembly 80 by any suitable means such as, for example, a magnetic coupling.

With continued reference to FIG. 6, the rear access door assembly 92 is configured to provide selective access to the storage area 74 from within the building interior 18. In the example implementation, the rear access door assembly 92 generally includes a rear door 140, a hinge assembly 142, and a dampening device 144. The rear door 140 includes an insulation layer 145 disposed between a rear outer panel 146 and a rear inner panel 148. As shown, the rear door 140 is rotatably coupled to an upper edge of the partial back wall assembly 90 by the hinge assembly 142. One or more dampening devices 144 are coupled between the rear inner panel 148 and side wall assemblies 82 to dampen the opening/closing of rear door 140 as well as support the weight thereof. In the illustrated example, the dampening device 144 is a gas spring. However, it will be appreciated that dampening device 144 may be any suitable device that enables drawer assembly 32 to function as described herein, such as, for example a biasing mechanism or actuator.

In the example embodiment, the front door assembly 94 generally includes a front panel door 150, an insulation layer 151, and a handle assembly 152. The front panel door 150 includes an electronics aperture 154 formed therethrough and is coupled to at least one of the front wall assembly 80, the side wall assemblies 82, and the bottom wall assembly 84. The front panel door 150 is sized and shaped fit tightly within and be substantially flush with the frame 48 when the drawer 70 is moved to the closed position.

As illustrated in FIG. 6, the handle assembly 152 includes a handle outer member 156 and a handle bottom member 158 disposed between opposed handle side members 160, which are coupled to the front panel door 150 proximate the electronics aperture 154. In this way, the handle assembly 152 defines a handle 162 for the delivery person to grip when opening the drawer 70. Further, the handle outer member 156 defines a support surface 164 to support at least a portion of the exterior keypad and lock assembly 36, as well as an electronics aperture 166 to enable one or more portions of the exterior keypad and lock assembly 36 to pass therethrough to the other electronics aperture 154 formed in the front panel door 150.

With continued reference to FIG. 6, the drawer 70 is slidably coupled to the frame assembly 30 by opposed drawer slide assemblies 72. In the example embodiment, each drawer slide assembly 72 includes an outer cabinet member 170, an intermediate member 172, and an inner drawer member 174. The outer cabinet members 170 are coupled to the inner surface of the shell side walls 58 and are configured to slidingly receive the intermediate member 172. The inner drawer member 174 is coupled to the outer surface of the drawer side wall assembly 82 and is slidingly received within the intermediate member 172. One or more bearings (not shown), such as ball bearings, are disposed between the outer cabinet member 170, the intermediate member 172, and the inner drawer member 174 to enable the relative sliding movement therebetween.

As shown in FIGS. 2 and 6, drawer assembly 32 can include an actuator assembly 78 configured to automatically open or close the drawer 70 upon receiving a command signal from a device such as, for example, the exterior keypad and lock assembly 36, a computer or smartphone device controlled by the delivery person or the consumer, or an automated delivery device (e.g., a drone). In the example embodiment, the actuator assembly 78 is a linear actuator comprising a housing 180 with a motor 182 operably coupled to a ball screw 184 and a driven member 186. The housing 180 is coupled to the inside of the shell lower wall 56 (see FIG. 2) and houses the motor 182, which is operably coupled (e.g., geared) to one end of the ball screw 184. The driven member 186 is threadably coupled at one end to the ball screw 184, and fixed to the drawer 70 at the other end (e.g., at bottom wall assembly 84). Operation of the motor 182 is configured to rotate the ball screw 184 causing linear movement of the driven member 186 to thereby enable movement of the drawer 70 between the open and closed positions. It will be appreciated, however, that actuator assembly 78 can be any suitable actuator that enables drawer assembly 32 to function as described herein.

With continued reference to FIG. 6, the sleeve assembly 34 will be described in more detail. Sleeve assembly 34 is configured to provide a customizable and interchangeable show surface that enables the securable delivery storage container 10 to match or accentuate features or colors of the building interior 18. In one example embodiment, sleeve assembly 34 is a decorative paint/stain grade wood sleeve 190 with raised panel doors 192 to match existing cabinetry in the building interior 18. The sleeve 190 is substantially rectangular and includes an upper wall 194 and an opposite lower wall 196 coupled to and extending between a pair of opposed side walls 198. The upper wall 194 includes a first aperture 200 and a second aperture 202. The first and second apertures 200, 202 are configured to respectively align with shell first and second aperture 66, 68 to also respectively receive the heating/cooling unit 40 and the sanitization device 42. The doors 192 are rotatably coupled to the opposed side walls 198 and, in some configurations, may be utilized instead of rear doors 64. As such, one or more of the doors 192 can include the interior lock assembly 38 to selectively lock the doors in the closed position to facilitate preventing unauthorized access to the drawer assembly 32.

Figure 3:
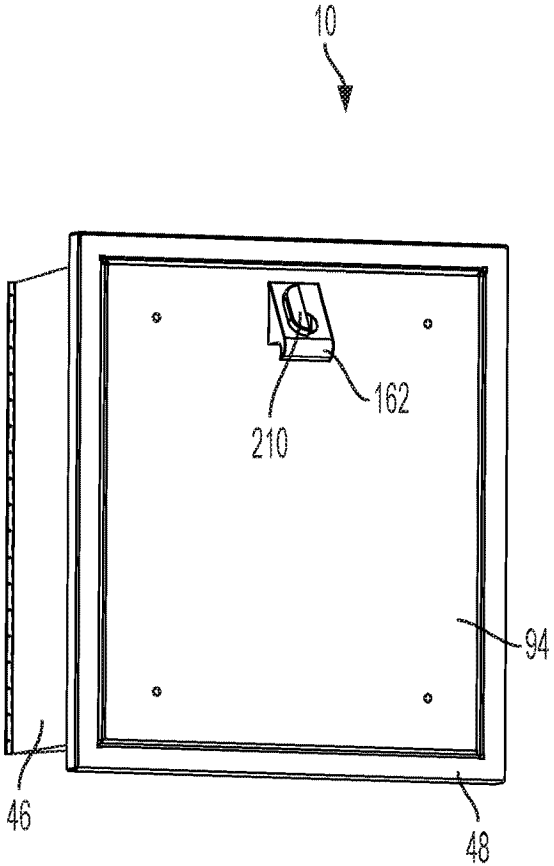
FIG. 3 is a front perspective view of the securable delivery storage container of FIG. 1 shown in a closed position.

With reference now to FIGS. 3, 5 and 6, the exterior keypad and lock assembly 36 will be described in more detail. In the example embodiment, the exterior keypad and lock assembly 36 are configured to selectively lock the drawer 70 to the frame assembly 30 to facilitate preventing relative movement therebetween until an authorized user provides a valid access code. The exterior keypad and lock assembly 36 generally includes a keypad 210 in signal communication with a lock 212. The keypad 210 is coupled to the handle assembly support surface 164, which is positioned at an angle to display the keypad 210 to the delivery person. The keypad 210 is a programmable keypad and includes a plurality of alpha-numeric keys or buttons, a processor, and memory (not shown) to generate and store one or more unique codes either on the keypad 210 or through a user device (e.g., through an app on a smart phone).

In the example embodiment, the keypad 210 is in signal communication with the lock 212, which includes an electromagnetic actuator 214 and a locking pin 216 (e.g., a deadbolt). The keypad 210 may be connected to the lock 212 via one or more electrical wires (not shown) passing through electronics apertures 154, 166, or via a wireless connection. If an operator inputs a valid code on the keypad 210, an electrical signal is generated to command the electromagnetic actuator 214 to move the locking pin 216 downwardly to disengage from the frame assembly 30. This allows the drawer 70 to slide outward relative to the stationary frame assembly 30 to thereby permit access to the storage area 74. Once the drawer 70 is moved to the closed position, the keypad 210 may then be pressed or activated to generate another electrical signal to command the electromagnetic actuator 214 to move the locking pin 216 upwardly to engage the frame assembly 30 and prevent the drawer 70 from sliding outward relative to the stationary frame assembly 30.

Additionally, the keypad 210 can be in signal communication with the actuator assembly 78, and is configured to generate an electrical signal to command the actuator assembly 78 to move the drawer 70 into the open or closed positions. For example, when a valid code is entered into the keypad 210, the lock 212 is unlocked, and the actuator assembly 78 is subsequently activated to move the drawer 70 to the open position. A subsequent press of the keypad 210 directs the actuator assembly 78 to move the drawer 70 to the closed position and subsequently locks the lock 212. In some configurations, keypad 210 is configured to receive one or more wireless signals from an automated delivery device such as, for example, a drone. Once keypad 210 receives a valid code through the wireless signal, the drawer 70 is automatically operated as described above. Additionally, in some configurations, the keypad 210 (or other portion of container 10) can include a camera (not shown) that enables the consumer to monitor activity at the delivery storage container 10.

With continued reference to FIG. 6, the heating/cooling unit 40 will be described in more detail. In the example embodiment, the heating/cooling unit 40 is configured to control a temperature of the drawer storage area 74, for example, to maintain delivered groceries cool or delivered food hot while being stored within the delivery storage container 10. In the example implementation, the heating/cooling unit 40 is a thermoelectric (e.g., Peltier) device inserted at least partially through the shell upper wall first aperture 66. In this way, the thermoelectric heating/cooling unit 40 is positioned to heat or cool the environment within the storage 74 to a desired temperature, for example via input on keypad 210 or via a connected device (e.g., smartphone). Moreover, although shown as a single unit, delivery storage container 10 may have a plurality of heating/cooling units 40 in various locations throughout (e.g., in or on bottom wall assembly 84). It will be appreciated, however, that heating/cooling unit 40 may have other suitable configurations, such as a vapor-compression system having a compressor, condenser, expansion device, and evaporator operable between an AC mode and a heat pump mode to provide the desired temperature.

In the example embodiment, the sanitization device 42 is configured to sanitize the environment within the drawer storage area 74, for example, to kill viruses and bacteria that may be present on the delivered items. In the example implementation, the sanitization device 42 is a UV light configured to generate disinfecting UV radiation (UVA, UVB, and/or UVC) within the storage area 74. Although shown as a single device, delivery storage container 10 may have any suitable number of sanitization devices 42 that enables the system to function as described herein. Moreover, it will be appreciated that sanitization device 42 may have other suitable configurations, such as a device that periodically sprays a sanitizing mist to kill viruses and bacteria.

Described herein are systems and methods for a securable delivery storage container for installation in a building wall that enables a delivery person to access a slidable drawer through an external keypad. Easy to follow instructions on the delivery storage container make deliveries convenient for the delivery person and the delivered items remain safely locked and protected until the consumer retrieves the items from the other side of the delivery storage container on the interior of the building. The keypad is programmable and enables a user to create a unique, changeable code either on the keypad or through a phone app to monitor activity of the delivery storage container. Using the device or phone app, the consumer is alerted when a package is delivered, and an optional camera allows the consumer to monitor deliveries.

It will be understood that the mixing and matching of features, elements, methodologies, systems and/or functions between various examples may be expressly contemplated herein so that one skilled in the art will appreciate from the present teachings that features, elements, systems and/or functions of one example may be incorporated into another example as appropriate, unless described otherwise above. It will also be understood that the description, including disclosed examples and drawings, is merely exemplary in nature intended for purposes of illustration only and is not intended to limit the scope of the present disclosure, its application or uses. Thus, variations that do not depart from the gist of the present disclosure are intended to be within the scope of the present disclosure.

What is claimed is:

1. A securable delivery storage container configured to extend through a wall of a building and comprising:

a frame assembly configured to be inserted into the wall and including a first open end disposed at an exterior of the building, and an opposite second open end disposed at an interior of the building;

a drawer assembly defining a storage area configured to receive deliverables, the drawer assembly slidingly coupled to the frame assembly and slidable between (i) a closed position where the drawer assembly is nested within the frame assembly to prevent access to the storage area from the building exterior, and (ii) an open position where the drawer assembly is extended outwardly from the frame assembly to enable access to the storage area from the building exterior;

wherein the drawer assembly includes a first side providing a first access point to the storage area on the exterior of the building, and a second side providing a second access point to the storage area on the interior of the building; and an exterior keypad and lock assembly configured to selectively lock the drawer assembly to the frame assembly when the drawer assembly is in the closed position, wherein the exterior keypad and lock assembly comprises:

a locking pin movable between a locked position where the locking pin extends into the frame assembly, and an unlocked position where the locking pin is withdrawn from the frame assembly;

an actuator operably coupled to the locking pin and configured to selectively move the locking pin between the locked position and the unlocked position; and a keypad in signal communication with the actuator, wherein the keypad is configured to generate a signal to command the actuator to move the locking pin between the locked position and the unlocked position.

2. The securable delivery storage container of claim 1, wherein the keypad is programmable to generate and store at least one unique access code, and wherein when the drawer assembly is in the closed position, the locking pin is in the locked position, and the at least one unique access code is input into the keypad, the keypad generates the signal to command the actuator to move the locking pin between the locked position and the unlocked position.

3. The securable delivery storage container of claim 2, wherein the keypad is programmable to generate and store a plurality of unique one-time use access codes to supply to delivery persons to open the drawer assembly and place deliverables in the storage area.

4. The securable delivery storage container of claim 1, further comprising a heating/cooling unit coupled to at least one of the frame assembly and the drawer assembly and configured to selectively heat or cool the environment within the storage area based on a type of deliverables.

5. The securable delivery storage container of claim 4, wherein the heating/cooling unit is a thermoelectric device.

6. The securable delivery storage container of claim 1, further comprising a sanitization unit coupled to at least one of the frame assembly and the drawer assembly and configured to selectively sanitize the environment within the storage area.

7. The securable delivery storage container of claim 6, wherein the sanitization unit is a UVC light configured to generate UVC radiation.

8. The securable delivery storage container of claim 1, wherein the drawer assembly comprises a drawer slidably coupled to the frame assembly by a drawer slide assembly.

9. The securable delivery storage container of claim 8, wherein the drawer comprises:

a front wall assembly;

a partial back wall assembly;

a bottom wall assembly; and a pair of opposed sidewall assemblies extending between the front wall assembly and the partial back wall assembly.

10. The securable delivery storage container of claim 9, further comprising a stowable shelf rotatably coupled to the front wall assembly and movable between a horizontal deployed position that provides a shelf surface within the storage area, and a vertical stowed position disposed against the front wall assembly.

11. The securable delivery storage container of claim 1, wherein the frame assembly comprises an upper wall, a lower wall, and a pair of opposed side walls extending between the upper wall and the lower wall, wherein the frame assembly defines a cavity configured to receive the drawer assembly therein.

12. A securable delivery storage container configured to extend through a wall of a building and comprising:

a frame assembly configured to be inserted into the wall and including a first open end disposed at an exterior of the building, and an opposite second open end disposed at an interior of the building; and a drawer assembly defining a storage area configured to receive deliverables, the drawer assembly slidingly coupled to the frame assembly and slidable between (i) a closed position where the drawer assembly is nested within the frame assembly to prevent access to the storage area from the building exterior, and (ii) an open position where the drawer assembly is extended outwardly from the frame assembly to enable access to the storage area from the building exterior;

wherein the drawer assembly includes a first side providing a first access point to the storage area on the exterior of the building, and a second side providing a second access point to the storage area on the interior of the building, wherein the drawer assembly comprises a drawer slidably coupled to the frame assembly by a drawer slide assembly, and wherein the drawer comprises:

a front wall assembly;

a partial back wall assembly;

a bottom wall assembly;

a pair of opposed sidewall assemblies extending between the front wall assembly and the partial back wall assembly; and a rear access door assembly configured to selectively close the second access point to the storage area on the interior of the building.

13. The securable delivery storage container of claim 12, further comprising an exterior keypad and lock assembly configured to selectively lock the drawer assembly to the frame assembly when the drawer assembly is in the closed position.

14. The securable delivery storage container of claim 13, wherein the exterior keypad and lock assembly comprises:

a locking pin movable between a locked position where the locking pin extends into the frame assembly, and an unlocked position where the locking pin is withdrawn from the frame assembly;

an actuator operably coupled to the locking pin and configured to selectively move the locking pin between the locked position and the unlocked position; and a keypad in signal communication with the actuator, wherein the keypad is configured to generate a signal to command the actuator to move the locking pin between the locked position and the unlocked position.

15. The securable delivery storage container of claim 12, wherein the rear access door assembly comprises a rear door rotatably coupled to the partial back wall assembly via a hinge assembly, and wherein the rear door is movable between an open position allowing access to the storage area via the second access point, and a closed position preventing access to the storage area via the second access point.

16. The securable delivery storage container of claim 15, wherein the rear door includes an interior lock assembly configured to selectively lock the rear door in the closed position to facilitate preventing unauthorized access to the storage area from the building interior.

17. A securable delivery storage container configured to extend through a wall of a building and comprising:

a frame assembly configured to be inserted into the wall and including a first open end disposed at an exterior of the building, and an opposite second open end disposed at an interior of the building; and a drawer assembly defining a storage area configured to receive deliverables, the drawer assembly slidingly coupled to the frame assembly and slidable between (i) a closed position where the drawer assembly is nested within the frame assembly to prevent access to the storage area from the building exterior, and (ii) an open position where the drawer assembly is extended outwardly from the frame assembly to enable access to the storage area from the building exterior;

wherein the drawer assembly includes a first side providing a first access point to the storage area on the exterior of the building, and a second side providing a second access point to the storage area on the interior of the building, wherein the frame assembly comprises an upper wall, a lower wall, and a pair of opposed side walls extending between the upper wall and the lower wall, wherein the frame assembly defines a cavity configured to receive the drawer assembly therein, and wherein the frame assembly further comprises a pair of lockable rear doors rotatably coupled to the pair of opposed side walls to facilitate preventing unauthorized access to the storage area from the building interior.

18. A method of providing security for items delivered to a building, the method comprising:

providing a frame assembly configured to be inserted into a wall of the building with a first open end disposed at an exterior of the building, and an opposite second open end disposed at an interior of the building;

providing a drawer assembly defining a storage area configured to receive the delivery item, the drawer assembly slidingly coupled to the frame assembly and slidable between (i) a closed position where the drawer assembly is nested within the frame assembly to prevent access to the storage area from the building exterior, and (ii) an open position where the drawer assembly is extended outwardly from the frame assembly to enable access to the storage area from the building exterior, wherein the drawer assembly includes a first side providing a first access point to the storage area on the exterior of the building, and a second side providing a second access point to the storage area on the interior of the building;

providing an exterior keypad and lock assembly comprising:

a locking pin movable between a locked position where the locking pin extends into the frame assembly, and an unlocked position where the locking pin is withdrawn from the frame assembly;

an actuator operably coupled to the locking pin and configured to selectively move the locking pin between the locked position and the unlocked position; and a keypad in signal communication with the actuator;

enabling sending of a unique access code to a delivery person delivering the item;

enabling generating of a signal, with the keypad, to command the actuator to move the locking pin from the locked position to the unlocked position when the unique access code is input into the keypad to enable the delivery person to access the storage area and deposit the item therein.

* * * * *